US006580215B2

(12) United States Patent
Nihashi

(10) Patent No.: US 6,580,215 B2
(45) Date of Patent: Jun. 17, 2003

(54) PHOTOCATHODE

(75) Inventor: Tokuaki Nihashi, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 173 days.

(21) Appl. No.: 09/741,826

(22) Filed: Dec. 22, 2000

(65) Prior Publication Data

US 2001/0001226 A1 May 17, 2001

Related U.S. Application Data

(63) Continuation-in-part of application No. PCT/JP98/02837, filed on Jun. 25, 1998.

(51) Int. Cl.[7] ..... H01J 40/06
(52) U.S. Cl. ..... 313/542; 313/532; 313/544
(58) Field of Search ..... 313/94, 95, 103 CM, 313/105 CM, 346 R, 351, 534, 542, 544, 552; 257/453, 449

(56) References Cited

U.S. PATENT DOCUMENTS

| | | | | |
|---|---|---|---|---|
| 2,791,712 A | | 5/1957 | Friedman et al. | |
| 3,814,968 A | * | 6/1974 | Nathason et al. | 313/95 |
| 3,986,065 A | * | 10/1976 | Pankove | 313/94 |
| 4,616,248 A | | 10/1986 | Khan et al. | 357/30 |
| 4,680,504 A | | 7/1987 | Helvy et al. | 313/524 |
| 5,045,509 A | | 9/1991 | Kiefer | 501/59 |
| 5,154,733 A | | 10/1992 | Fujii et al. | 95/57 |
| 5,264,693 A | | 11/1993 | Shimabukuro et al. | 250/207 |
| 5,278,435 A | | 1/1994 | Van Hove et al. | 257/184 |
| 5,378,960 A | * | 1/1995 | Tasker et al. | 313/103 CM |
| 5,557,167 A | | 9/1996 | Kim et al. | 313/542 |
| 5,982,093 A | * | 11/1999 | Nihashi et al. | 313/542 |
| 6,104,074 A | * | 8/2000 | Chen | 257/453 |

FOREIGN PATENT DOCUMENTS

| | | |
|---|---|---|
| EP | 0 829 898 | 3/1998 |
| JP | 61-267374 | 11/1986 |
| JP | 1-190835 | 7/1989 |
| JP | 3-89284 | 4/1991 |
| JP | 6-77437 | 9/1994 |
| JP | 7-36316 | 4/1995 |
| JP | 7-93098 | 10/1995 |
| JP | 8-96705 | 4/1996 |
| JP | 10-241554 | 9/1998 |

* cited by examiner

*Primary Examiner*—Don Wong
*Assistant Examiner*—Jimmy T. Vu
(74) *Attorney, Agent, or Firm*—Morgan, Lewis & Bockius LLP

(57) ABSTRACT

A photocathode having a UV glass substrate and a laminate composed of a $SiO_2$ layer, a GaAlN layer, a Group III–V nitride semiconductor layer and an AlN buffer layer provided on the UV glass substrate in succession. The UV glass substrate, which absorbs infrared rays, can be heat treated at a high speed by photoheating. Further, the UV glass substrate, which is transparent to ultraviolet rays, permits ultraviolet rays to be introduced into the Group III–V nitride semiconductor layer where photoelectric conversion occurs.

7 Claims, 5 Drawing Sheets

PHOTOCATHODE

RELATED APPLICATION

This is a continuation-in-part application of application serial no. PCT/JP98/02837 filed on Jun. 25, 1998, now pending.

BACKGROUND OF THE INVENTION

1. Field of the Invention

The present invention relates to a photocathode which is applicable to an image intensifier or a photomultiplier tube.

2. Related Background Art

Conventional photocathodes employing GaN are disclosed in Japanese Patent Application Laid-Open No. S61-267374 (U.S. Pat. No. 4,618,248), Japanese Patent Application Laid-Open No. H8-96705, U.S. Pat. No. 5,557,167 and U.S. Pat. No. 3,986,065. Such photocathodes have a sapphire substrate and a superlattice structure of AlGaN formed on the sapphire substrate.

SUMMARY OF THE INVENTION

The detection sensitivity of an electron tube employing a photocathode having a Group III–V nitride semiconductor layer (semiconductor layer of a nitride containing one or more elements selected from groups III–V of the periodic table), such as a GaN semiconductor layer, formed on a sapphire substrate depends on the crystallinity and surface cleanliness of the Group III–V nitride semiconductor layer. For improving characteristics of the Group III–V nitride semiconductor layer, heat treatment such as annealing and thermal cleaning is effective. Because a sapphire substrate has a relatively high transmissivity for ultraviolet rays, a photocathode employing the sapphire substrate can detect ultraviolet rays with a high efficiency. However, for not having a high absorbance for infrared rays, a sapphire substrate is difficult to be heated at a high speed in manufacturing the photocathode. Therefore, improvements in characteristics of the Group III–V nitride semiconductor layer by rapid heat treatment cannot be expected. The present invention has been made in view of these problems and is aimed at the provision of a photocathode which has improved characteristics and with which the throughput in manufacturing the same can also be improved.

With a view toward solving the above problems, a photocathode of the present invention comprises a UV glass substrate having one surface adapted to receive incident UV rays, an alkali-metal containing layer containing an alkali metal, and a Group III–V nitride semiconductor layer interposed between the other surface of the UV glass substrate and the alkali-metal containing layer and adapted to release electrons in response to incidence of the ultraviolet ray. The ultraviolet rays which have passed through the UV glass substrate are introduced into the Group III–V nitride semiconductor layer, where electrons are produced. The produced electrons are introduced into the alkali-metal containing layer containing an alkali metal such as Cs—O and can be emitted into a vacuum therethrough. A UV glass has higher absorbance for infrared rays and higher transmissivity for ultraviolet rays than sapphire. Thus, when the UV glass is employed as a substrate, the detection sensitivity for ultraviolet rays can be improved and both the substrate and the Group III–V nitride semiconductor layer provided on the substrate can be heated at a high speed.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENT

Figure 1:
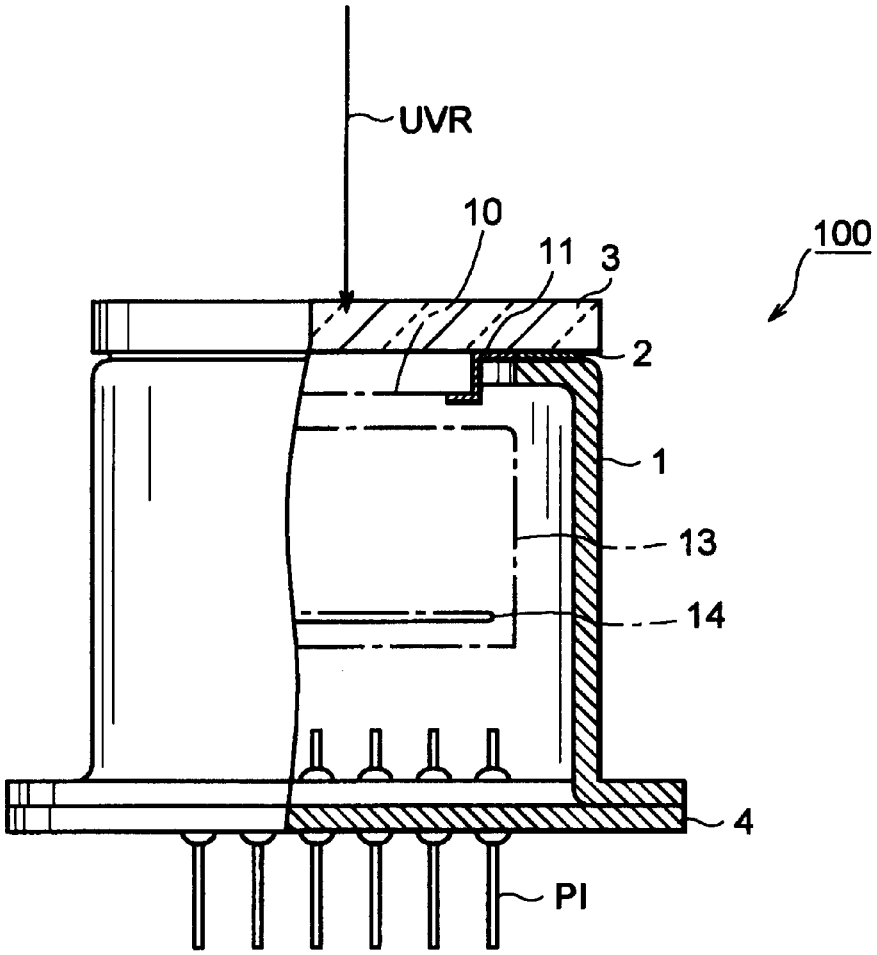
FIG. 1 is an elevational view, partly in cross-section, illustrating a photomultiplier tube.

A photocathode according to an embodiment of the present invention will be described hereinbelow. Like reference numerals will refer to like parts or the parts having like functions and overlapping explanations will be omitted. FIG. 1 is an elevational view, partly in cross-section, illustrating a photomultiplier tube 100 employing a photocathode of the present invention. The photomultiplier tube 100 includes a side tube 1 made of a metal, a UV glass substrate 3 sealing one opening of the side tube 1 with an In sealing material 2 interposed therebetween, and a bottom plate 4 sealing the other opening of the side tube 1 and provides a vacuum environment (a reduced pressure environment of 100 Torr (13332.24 Pa) or less) therewithin. A laminate 10 composed of a plurality of layers is provided on the surface of the UV glass substrate 3 inside the side tube 1. The UV glass substrate 3 and the laminate 10 constitute the photocathode.

The laminate 10 is electrically connected to the In sealing material 2 through a Cr electrode layer 11 provided on the UV glass substrate 3 and can be provided a given electric potential by applying the electric potential to the side tube 1 made of a metal. Ultraviolet rays UVR which have passed through the UV glass substrate 3 are subjected to a photoelectric conversion in the laminate 10 so that electrons are emitted into the side tube 1. The emitted electrons are multiplied by an electron multiplier 13 composed of a plurality of metal-channel-type dynodes and disposed within the side tube 1, and collected by an anode 14 provided in front of the last stage dynode of the electron multiplier 13.

The electrons in the side tube 1 are accelerated from the photocathode toward the anode by an electric field which is formed within the side tube 1 responsive to an electric potential applied to the laminate 10, the dynodes of the electron multiplier 13 and the anode 14 through a plurality of lead pins PI.

Figure 2:
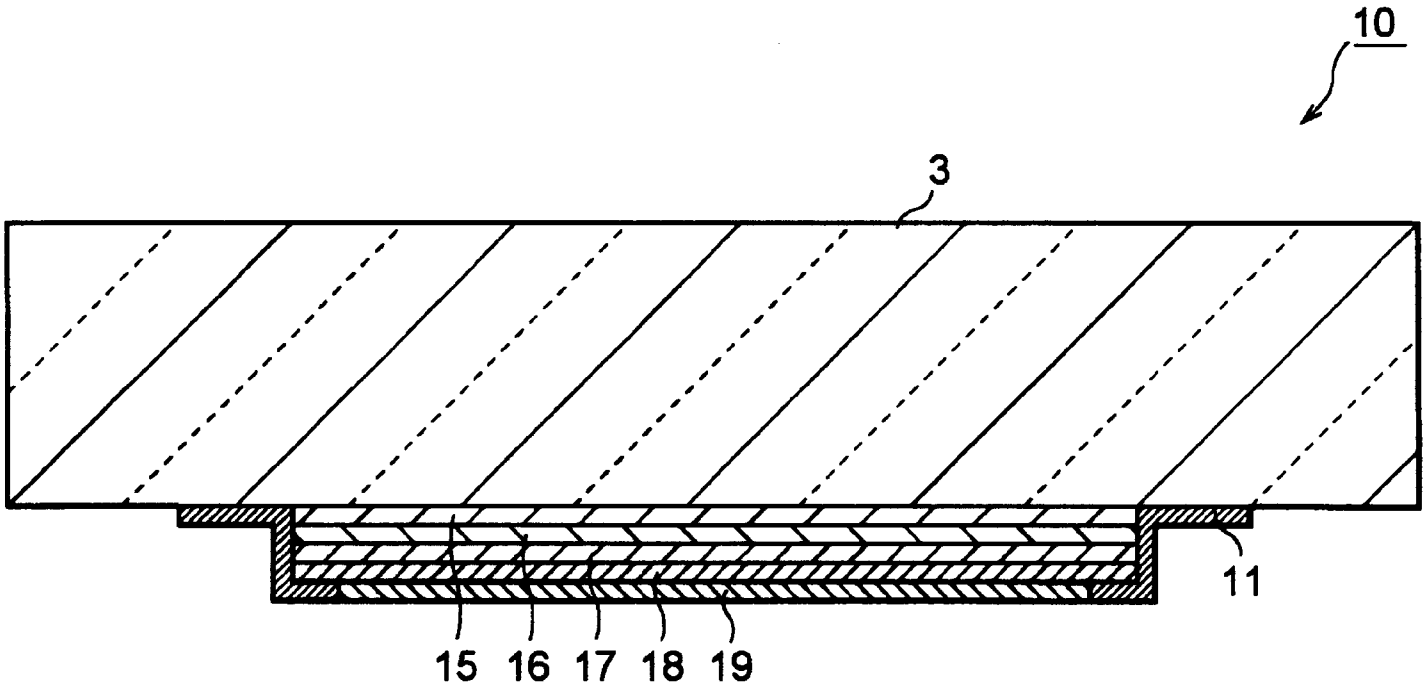
FIG. 2 is a cross-sectional view illustrating a photocathode according to an embodiment of the present invention.

FIG. 2 is a cross-sectional view of the photocathode shown in FIG. 1, which comprises the UV glass substrate 3 and the laminate 10. The photocathode comprises the UV glass substrate 3 having one surface adapted to receive incident UV rays, a Cs—O layer (an alkali-metal containing layer) 19 containing an alkali metal, and a Group III–V nitride semiconductor layer 18 which is interposed between the other surface of the UV glass substrate 3 and the Cs—O layer 19, which contains Ga and N and which releases electrons in response to the incidence of UV rays. An AlN buffer layer 17 and a sapphire substrate 16 are provided in succession on the UV glass substrate on the side of the Group III–V nitride semiconductor layer 18. The sapphire substrate 16 is secured to the UV glass substrate 3 through a $SiO_2$ layer 15.

Next, a method of manufacturing the photocathode shown in FIG. 2 will be described. First, a sapphire substrate 16 is prepared. The thickness of the sapphire substrate 16 is 0.1 to 0.2 mm. An AlN buffer layer 17 and a Group III–V semiconductor layer 18 are provided in succession on one side of the sapphire substrate 16. The AlN buffer layer is in an amorphous state and has a thickness of several tens of nanometer. The Group III–V nitride semiconductor layer 18 is in a single crystal state or a polycristal state. Further, a $SiO_2$ layer 15 having a thickness of 100 to 200 nm is provided on the other side of the sapphire substrate 16 by CVD.

Next, a UV glass substrate 3 is prepared and disposed in a vacuum as is the case of the laminate 10. The UV glass substrate 3 is then subjected to a photoheat treatment using a photoheating device which emits light including infrared rays to heat the surfaces thereof at a high speed for cleaning. Further, the UV glass substrate 3 and the laminate 10 are heated to the glass softening point at a high speed. The UV glass substrate 3 is contacted with the $SiO_2$ layer 15 of the laminate 10 in a vacuum. A load of about 100 g/cm$^2$ is applied onto the $SiO_2$ layer so that the sapphire substrate 16 may be heat-bonded to the UV glass substrate 3 with the $SiO_2$ layer interposed therebetween. Crystallinity of the laminate 10 is improved by heating.

For the UV glass substrate 3, a UV glass substrate having a coefficient of thermal expansion similar to that of the sapphire substrate 16 and containing proper ions may be selected. Such UV glass substrates include 9741 manufactured by Corning Inc. and 8337B manufactured by Shot Inc. The UV glass substrate 3 may be previously so shaped as to permit fixation to the electron tube 100. Then, an electrode 11 extending from the UV glass substrate 3 to an exposed surface of the Group III–V nitride semiconductor layer 18 is provided by vapor deposition. The material of the electrode may be Cr, Al, Ni, and so on. Finally, a Cs—O layer 19 is formed on an exposed surface of the Group III–V semiconductor layer 18, thereby completing the photocathode shown in FIG. 2.

When the above mentioned laminate 10 receive incident UV rays through the UV glass substrate 3, positive hole electron pairs are produced in the Group III–V nitride semiconductor layer 18. The produced electrons are directed toward the Cs—O layer 19. Because the Cs—O layer 19 has a low function of work, the electrons which have arrived at the Cs—O layer 19 are emitted into a vacuum with ease. Next, a photocathode according to another embodiment will be described. The photocathode comprises a UV glass substrate 3 and a laminate 10 composed of a $SiO_2$ layer 15, a GaAlN layer 17*a*, a Group III–V nitride semiconductor layer 18 and an AlN buffer layer 17 provided on the UV glass substrate 3 in succession. The photocathode may be manufactured by a method described below.

Figure 3:
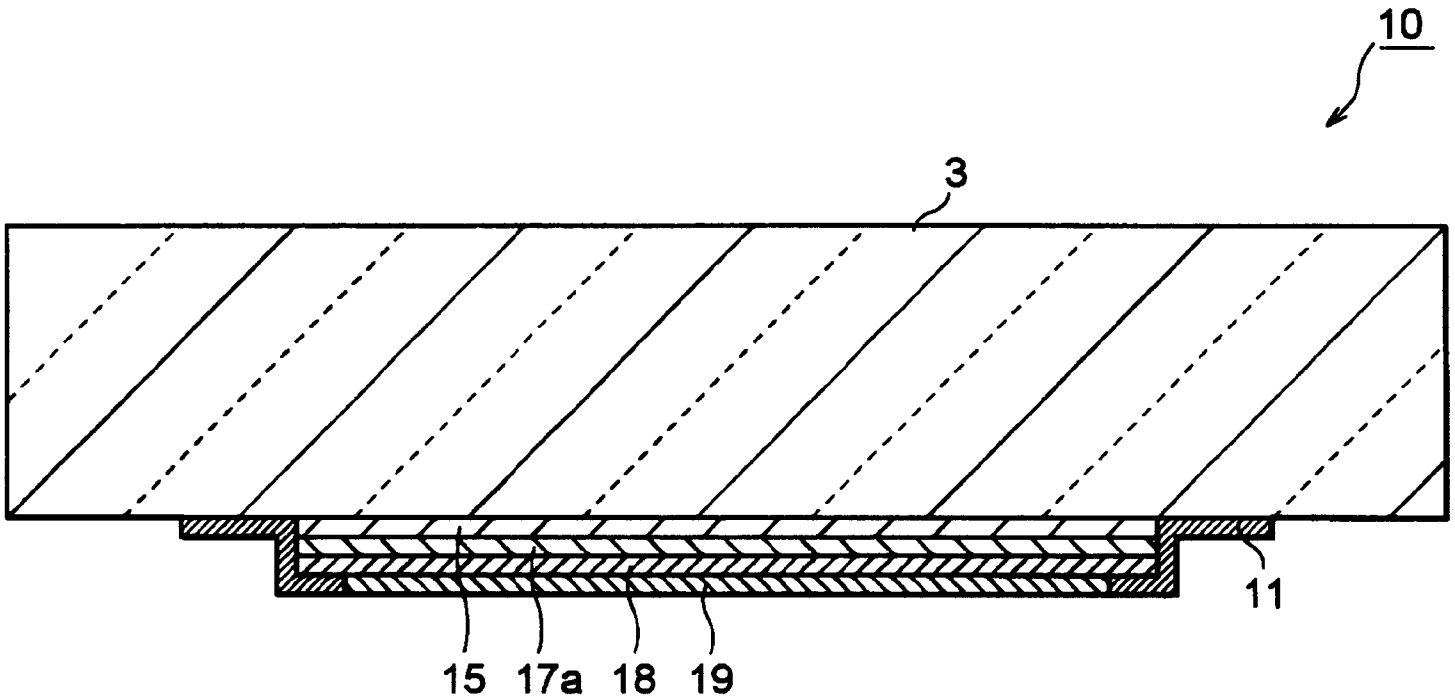
FIG. 3 is a cross-sectional view illustrating a photocathode according to another embodiment of the present invention.
Figure 4:
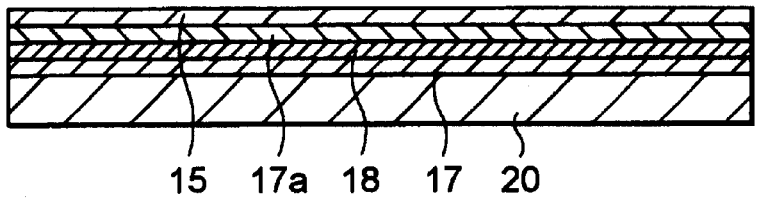
FIG. 4 is an illustration explanatory of a method of manufacturing the photocathode shown in FIG. 3.
Figure 5:
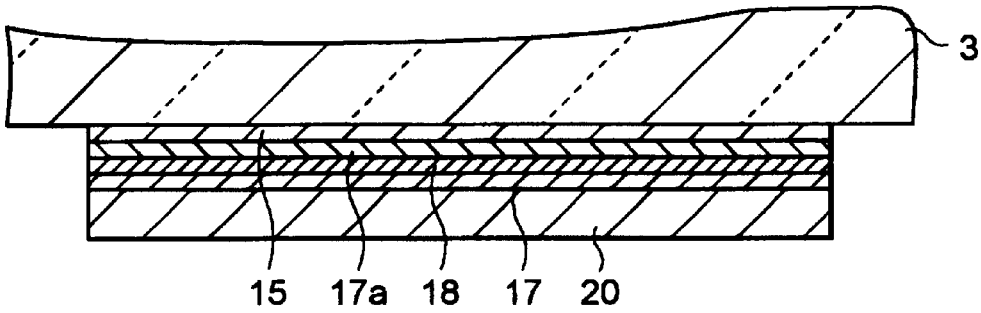
FIG. 5 is an illustration explanatory of a method of manufacturing the photocathode shown in FIG. 3.
Figure 6:
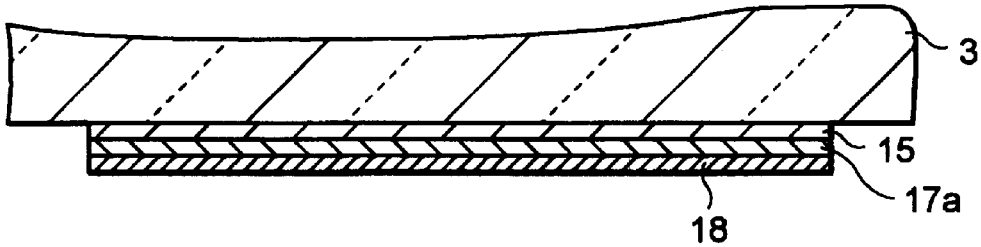
FIG. 6 is an illustration explanatory of a method of manufacturing the photocathode shown in FIG. 3.

FIG. 4 to FIG. 6 are each an explanatory diagram illustrating the steps of manufacturing the photocathode shown in FIG. 3.

First, as shown in FIG. 4, an AlN buffer layer 17, a Group III–V nitride semiconductor layer 18, a GaAlN layer ($Ga_xAl_{1-x}N$ ($0 \leqq x \leqq 1$)) 17*a* and a $SiO_2$ layer 15 are laminated in succession on a $LiGaO_2$ substrate 20. The $SiO_2$ layer 15 is provided by CVD and has a thickness of 100 to 200 nm.

Then, as shown in FIG. 5, a UV glass substrate 3 is prepared and disposed in a vacuum. Thereafter, the UV substrate 3 is subjected to a photoheat treatment using a photoheating device which emits light including infrared rays to clean the surfaces thereof at a high speed. Further, the UV glass substrate 3 and the laminate 10 are heated to the glass softening point at a high speed. The UV glass substrate 3 is contacted with the $SiO_2$ layer 15 of the laminate 10 in a vacuum. A load of about 100 g/cm$^2$ is applied onto the $SiO_2$ layer so that the $LiGaO_2$ substrate 20 may be heat-bonded to the UV glass substrate 3 with the $SiO_2$ layer interposed therebetween. Crystallinity of the laminate 10 is improved by heating at a high speed.

After that, as shown in FIG. 6, the $LiGaO_2$ substrate 20 is removed by reaction with oxygen with heating. Also, the AlN buffer layer 17 is removed by reactive ion etching using plasma of mixed gas of $BCl_3$ and $N_2$. Then, the Group III–V nitride semiconductor layer 18 is annealed to recover the crystallinity thereof. Thereafter, an electrode 11 extending from the UV glass substrate 3 to an exposed surface of the Group III–V nitride semiconductor layer 18 is provided by vapor deposition. Finally, a Cs—O layer 19 is formed on an exposed surface of the Group III–V semiconductor layer 18, thereby completing the photocathode shown in FIG. 3. Instead of the $LiGaO_2$ substrate 20, a sapphire substrate or a $LiAlO_2$ substrate may be employed. A Si substrate, a GaAs substrate or a GaP substrate may also be employed in place of the $LiGaO_2$ substrate 20. For the Group III–V nitride semiconductor layer 18, GaAlN, GaInN or GaAlInN may be employed in place of GaN as long as it contains Ga and N atoms in the crystal thereof. Instead of the Cs—O layer 19, the alkali metal containing layer may be formed of any one of Cs—I, Cs—Te, Sb—Cs, Sb—Rb—Cs, Sb—K—Cs, Sb—Na—K, Sb—Na—K—Cs and Ag—O—Cs, or a combination thereof. Further, heating in manufacturing may be by resistance heating rather than photoheating.

Figure 7:
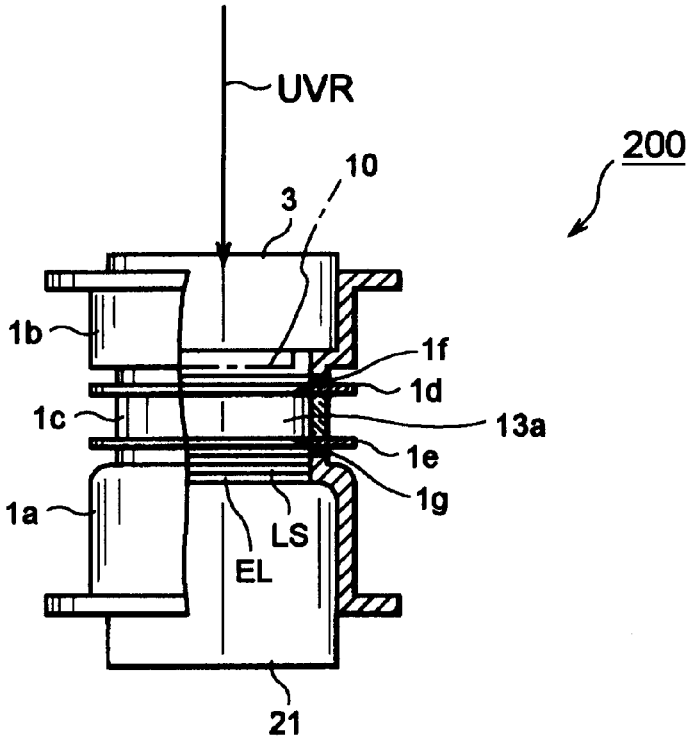
FIG. 7 is an elevational view, partly in cross-section, illustrating an II tube.

The photocathodes 3 and 10 according to the above mentioned two embodiments can be applicable to an electron tube such as an image intensifier as well as a photomultiplier tube. FIG. 7 is an elevational view, partly in cross-section, illustrating an image intensifier (II tube) 200 employing the photocathode. The II tube 200 has a side tube including side tubes 1*a* and 1*b* made of a metal and a side tube 1*c* made of a glass and disposed therebetween through metal rings 1*d* and 1*e* and insulator rings 1*f* and 1*g*. One opening of the side tube is sealed with a UV glass substrate 3 with the other opening being sealed with an optical fiber plate 21, so that the thus constituted housing may be provided with a reduced pressure environment in the interior thereof. An MCP (micro-channel plate) 13*a* as an electron multiplier is disposed between the fiber plate 21 and the photocathode composed of the UV glass substrate 3 and the laminate 10. The MCP 13*a* multiplies the electrons emitted from the photocathode. The multiplied electrons are directed towards an Al electrode EL secured to the receiving side of the optical fiber plate 21 with a fluorescent substance LS. The electrons are converted to fluorescence upon collision with the fluorescent substance LS. The converted fluorescence is outputted from the II tube 200 through the optical fiber plate 21.

As described above, since the photocathode according to the embodiments of the present invention employs the UV glass substrate 3 and the Group III–V nitride semiconductor layer 18, there can be accomplished an improvement in productivity thereof and an improvement in the detection sensitivity of an electron tube employing the same. Additionally, the UV glass substrate 3 has higher transmissivity for ultraviolet rays of wavelength of 240 nm or more than a sapphire glass so that the photocathode using the UV glass substrate can have high detection sensitivity for ultraviolet rays. Also, the UV glass substrate 3 has higher absorbance for infrared rays of wavelength of 2 $\mu$m or more than sapphire so that it can be heated at a high speed and thus there can be accomplished the recovery of the crystallinity and cleaning of the surfaces of the Group III–V nitride semiconductor layer provided thereon, and an improvement in throughput in manufacturing the photocathode.

As described above, with the photocathode of the present invention, there can be accomplished an improvement in productivity thereof and an improvement in the detection sensitivity of an electron tube employing the same.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photocathode comprising:

a UV glass substrate having one surface adapted to receive incident UV rays, an alkali-metal containing layer containing an alkali metal, and a Group III–V nitride semiconductor layer interposed between said UV glass substrate and said alkali-metal containing layer and adapted to release electrons in response to incidence of the ultraviolet rays.

2. The photocathode as recited in claim 1, wherein said alkali-metal containing layer comprises at least one member selected from the group consisting of Cs—O, Cs—I, Cs—Te, Sb—Cs, Sb—Rb—Cs, Sb—K—Cs, Sb—Na—K, Sb—Na—K—Cs and Ag—O—Cs.

3. The photocathode as recited in claim 2, wherein said Group III–V nitride semiconductor layer comprises at least one member selected from the group consisting of GaN, GaAlN, GaInN and GaAlInN.

4. The photocathode as recited in claim 1, further comprising:

a sapphire substrate interposed between said UV glass substrate and said Group III–V nitride semiconductor layer.

5. The method for manufacturing the photocathode as recited in claim 1, comprising the steps of:

forming a laminate by using the steps of:

preparing a first substrate;

forming said Group III–V nitride semiconductor layer on one surface of said first substrate; and forming a $SiO_2$ layer on the other surface of said first substrate; and preparing said UV glass substrate; and heat bonding said UV glass substrate with said $SiO_2$ layer while heating said UV glass and said $SiO_2$ layer to a glass softening point, thereby improving the crystallinity of said laminate.

6. The method recited in claim 5, wherein said first substrate is a sapphire substrate.

7. The method recited in claim 5, wherein said first substrate is a $LiGaO_2$ substrate.

* * * * *